US010895204B2

(12) United States Patent
Hamasaki

(10) Patent No.: US 10,895,204 B2
(45) Date of Patent: Jan. 19, 2021

(54) THROTTLE DEVICE

(71) Applicant: Mikuni Corporation, Tokyo (JP)

(72) Inventor: Daisuke Hamasaki, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 16/250,556

(22) Filed: Jan. 17, 2019

(65) Prior Publication Data

US 2019/0277203 A1 Sep. 12, 2019

(30) Foreign Application Priority Data

Jan. 23, 2018 (JP) ..... 2018-008806
Nov. 22, 2018 (JP) ..... 2018-219634

(51) Int. Cl.
*F02D 9/10* (2006.01)
*F02D 9/02* (2006.01)
*F02D 11/10* (2006.01)

(52) U.S. Cl.
CPC ..... *F02D 9/1095* (2013.01); *F02D 9/02* (2013.01); *F02D 9/105* (2013.01); *F02D 9/1065* (2013.01); *F02D 11/10* (2013.01); *F02D 2009/0272* (2013.01); *F02D 2009/0298* (2013.01)

(58) Field of Classification Search
CPC ..... F02D 9/1095; F02D 9/1065; F02D 11/10; F02D 9/105; F02D 9/02; F02D 2009/0272; F02D 2009/0298
See application file for complete search history.

(56) References Cited

U.S. PATENT DOCUMENTS 5,251,583 A * 10/1993 Shiohara ..... F02M 35/10104 123/73 D
6,202,626 B1 3/2001 Ito et al.
7,168,517 B2 * 1/2007 Udono ..... F02B 23/08 123/399
7,546,829 B2 * 6/2009 Samoto ..... F02D 9/1065 123/361

(Continued)

FOREIGN PATENT DOCUMENTS

EP 1 464 811 A2 10/2004
EP 1 464 811 A3 1/2009

(Continued)

*Primary Examiner* — Joseph J Dallo
*Assistant Examiner* — Kurt Philip Liethen
(74) *Attorney, Agent, or Firm* — Venable LLP; Henry J. Daley

(57) ABSTRACT

A throttle device, including: a throttle valve (13) disposed in a plurality of intake passages (12) of a throttle body (11); a throttle shaft (14) supporting the throttle valve (13); a motor (15) for driving the throttle valve (13) to open and close through the throttle shaft (14); a rotation transmission mechanism (20) interposed between the motor (15) and the throttle shaft (14); and a position sensor to detect a displacement in the rotation transmission mechanism (20). The rotation transmission mechanism (20) is disposed at a position where the first and the second throttle bodies (11*f*, 11*s*) are adjacent, the motor (15) is disposed within an installation width Ws of either one of the first and the second throttle bodies (11*f*, 11*s*), and the throttle opening degree sensor (30) is disposed within an installation width Wt of the other one of the first and the second throttle bodies (11*f*, 11*s*).

6 Claims, 6 Drawing Sheets

(56) References Cited

U.S. PATENT DOCUMENTS

| | | | | |
|---|---|---|---|---|
| 8,042,514 | B2 * | 10/2011 | Arnold | F02D 9/109 123/336 |
| 8,047,180 | B2 * | 11/2011 | Sato | F02M 35/10032 123/336 |
| 8,051,832 | B2 * | 11/2011 | Hotta | F02D 13/06 123/399 |
| 2010/0132663 | A1 * | 6/2010 | Hamasaki | F02D 9/1065 123/336 |

FOREIGN PATENT DOCUMENTS

| | | | |
|---|---|---|---|
| EP | 2 143 914 | A1 | 1/2010 |
| EP | 2 390 487 | A1 | 11/2011 |
| EP | 2 599 984 | A2 | 6/2013 |
| EP | 2 599 984 | A3 | 6/2015 |
| JP | 2003-201883 | A | 7/2003 |
| JP | 2010-019137 | A | 1/2010 |
| JP | 2012-159052 | | 8/2012 |
| JP | 5901255 | | 3/2016 |

* cited by examiner

THROTTLE DEVICE

CROSS-REFERENCE TO RELATED APPLICATIONS

This application claims benefit of Japanese Patent Application No. 2018-008806, filed Jan. 23, 2018, and Japanese Patent Application No. 2018-219634, filed Nov. 22, 2018

FIELD OF THE INVENTION

The present invention relates to a throttle device, and more specifically to a throttle device suitable for a multiple throttle device that controls the opening degree by a common actuator for a plurality of throttle valves on an intake passage of an engine.

BACKGROUND ART

In an electronic throttle device of a multi-cylinder internal combustion engine, specifically a throttle device of an engine mounted on a two-wheeled vehicle, by-wire type multiple-line devices, in which a plurality of throttle valves disposed in a plurality of intake passages in the vicinity of an intake port are driven and synchronized by a common electric actuator, are frequently used.

As a throttle device of this type, for example, a throttle device in which a throttle shaft supporting a throttle valve is driven by a motor with a speed reduction mechanism, while a rotation (an angular displacement) of a throttle shaft is transmitted to a sensor shaft arranged in parallel therewith by a gear, so that the angular displacement thereof is detected by a throttle position sensor as an opening degree of a throttle valve (See, for example, the Patent Document 1).

In this device, the gear for rotation transmission from the throttle shaft to the sensor shaft and the motor with the sensor shaft, the throttle position sensor, and the speed reduction mechanism are set on the center side in the direction in which the plurality of intake passages are adjacent (cylinder arrangement direction), so that the full width of the throttle body can be prevented from being increased by the gear train for rotational transmission from the motor to the throttle shaft being positioned at the end of the throttle body.

As a conventional throttle position sensor, there is, for example, a throttle position sensor in which a brush and a magnet on the movable side are fixed to a rotor such as a sensor shaft, while a resistor and a Hall element on the fixed side are fixed to a fixing member such as a throttle body, and, for example, a brush slides on the resistor according to the rotation of the rotor, so that a voltage signal corresponding to the rotation of the throttle shaft can be output to the outside (see, for example, Patent Documents 2 and 3).

CITATION LIST

Patent Literature

[Patent Document 1] Japanese Patent No. 5901255

[Patent Document 2] Japanese Patent Application Laid-Open No. 2003-201883

[Patent Document 3] Japanese Patent Application Laid-Open No. 2010-19137

SUMMARY OF THE INVENTION

Technical Problem

However, in the throttle device as described in the aforementioned Patent Document 1,3, in addition to providing a sensor shaft having a different axis from the throttle shaft in the vicinity of the center of the throttle body in the direction in which the plurality of intake ports are adjacent to each other, the gears for rotation transmission from the throttle shaft to the sensor shaft, the sensor shaft, the throttle position sensor, the motor with the speed reduction mechanism, and the like are concentratedly arranged.

Therefore, in conventional throttle devices, there is no choice other than to widen the interval between the two intake passages at the center of the throttle devices, so that there is a difficulty in mountability to the body frame of two-wheel vehicle, due to the full width in an alignment direction of the cylinders of the engine being increased.

Not only that, since the throttle position sensor detects not the rotation of the throttle shaft directly connected to the throttle valve but the rotation of the sensor shaft interlocked with the throttle shaft through the gear, the detection accuracy of the angular position (rotational displacement) is not sufficiently improved due to error factors such as backlash and the like.

Further, since the throttle devices described in the Patent Document 2, 3 are so configured that magnet or the like is disposed at the shaft end of a rotor such as the throttle shaft or the sensor shaft and a sensor for detection of the rotation is disposed in a fixed side member opposed to the magnet or the like, sufficient accuracy of angular positional detection is not obtained, due to not only the full width of the throttle device in the alignment direction of the cylinders of the engine being increased but a small rotational radius of the detection portion and the like.

The present invention has been made to solve the above-described conventional problems, and for the purpose of providing a compact throttle device with a reduced full width of the throttle body of the throttle device that has a throttle position sensor with high accuracy of throttle opening degree detection.

Means to Solve the Problem

To achieve the above object, a throttle device according to the present invention is a throttle device mountable on a multiple cylinder engine having an intake port, the throttle device comprising: a first throttle body having a first intake passage formed therein; a second throttle body having a second intake passage formed therein; a throttle valve rotatably provided respectively in the first and the second intake passages; a throttle shaft supporting the throttle valve; an actuator that drives the throttle valve to open and close through the throttle shaft; a rotation transmission mechanism interposed between the actuator and the throttle shaft; a displacement transmission mechanism connected to the throttle shaft and transmits a rotational displacement of the throttle shaft to a predetermined detection position; and a throttle opening degree sensor to detect the opening degree of the throttle valve the displacement transmission mechanism, wherein the rotation transmission mechanism is disposed at a position where the first throttle body and the second throttle body are adjacent, the actuator is disposed within an installation width of either one of the first and the second throttle bodies, and the throttle opening degree sensor is disposed within an installation width of the other one of the first and the second throttle bodies.

In the throttle device according to the present invention, the rotation transmission mechanism is disposed in the vicinity of the position where the first and the second throttle bodies are adjacent to each other, and the actuator is disposed within an installation width of either one of the first and the second throttle bodies, and the throttle opening degree sensor is disposed within an installation width of the other one of the first and the second throttle bodies, respectively. Therefore, while the actuator is accommodated in one throttle body of the first and the second throttle bodies, the throttle opening degree sensor detecting the rotational displacement of the throttle shaft is disposed within the width of the other throttle body, so that the throttle opening degree sensor does not protrude from the end portion of the throttle body, thereby making it possible to reduce the width of the full width of the throttle device. And in addition, by appropriately setting a disposing position, particularly a rotation radius, of a movable side detection element which displacement is detected by the throttle opening degree sensor, it becomes possible to secure the required throttle opening degree detection accuracy through extending the detection width of the rotational displacement and the degree of freedom of the disposition and the size of the throttle opening degree sensor is increased.

The throttle device according to the present invention may be so configured that the displacement transmission mechanism is connected to the throttle shaft at an end portion side where the other one of the first and the second throttle bodies is not adjacent to the either one of the first and the second throttle bodies, and the throttle opening degree sensor is disposed in a intake passage side of the other one of the first and the second throttle bodies, with respect to the displacement transmission mechanism.

By this configuration, while the throttle opening degree sensor and the rotation transmission mechanism are disposed to be spaced apart from each other in the axial direction of the throttle shaft, the throttle opening degree sensor avoids from protruding in a width direction from the end portion of the throttle body, so that the full width of the throttle device can be reduced.

The throttle device according to the present invention is preferably configured that the throttle valve includes a first throttle valve provided in the first intake passage and a second throttle valve provided in the second intake passage, and the first throttle valve and the second throttle valve are fixed to an identical throttle shaft.

In this case, a plurality of throttle valves disposed in the plurality of intake passages in the vicinity of the intake ports of the engine can be driven by the identical actuator in response to the throttle operation in a high response and accurate manner.

Effect of the Invention

According to the present invention, it is unnecessary to dispose the throttle position sensor so as to protrude outside the full width range of the throttle body, thereby making it possible to miniaturize the throttle device and increase the degree of freedom of arrangement.

DETAILED DESCRIPTION OF THE INVENTION

Hereinafter, embodiments for carrying out the present invention will be described with reference to the drawings.

First Embodiment

Figure 1:
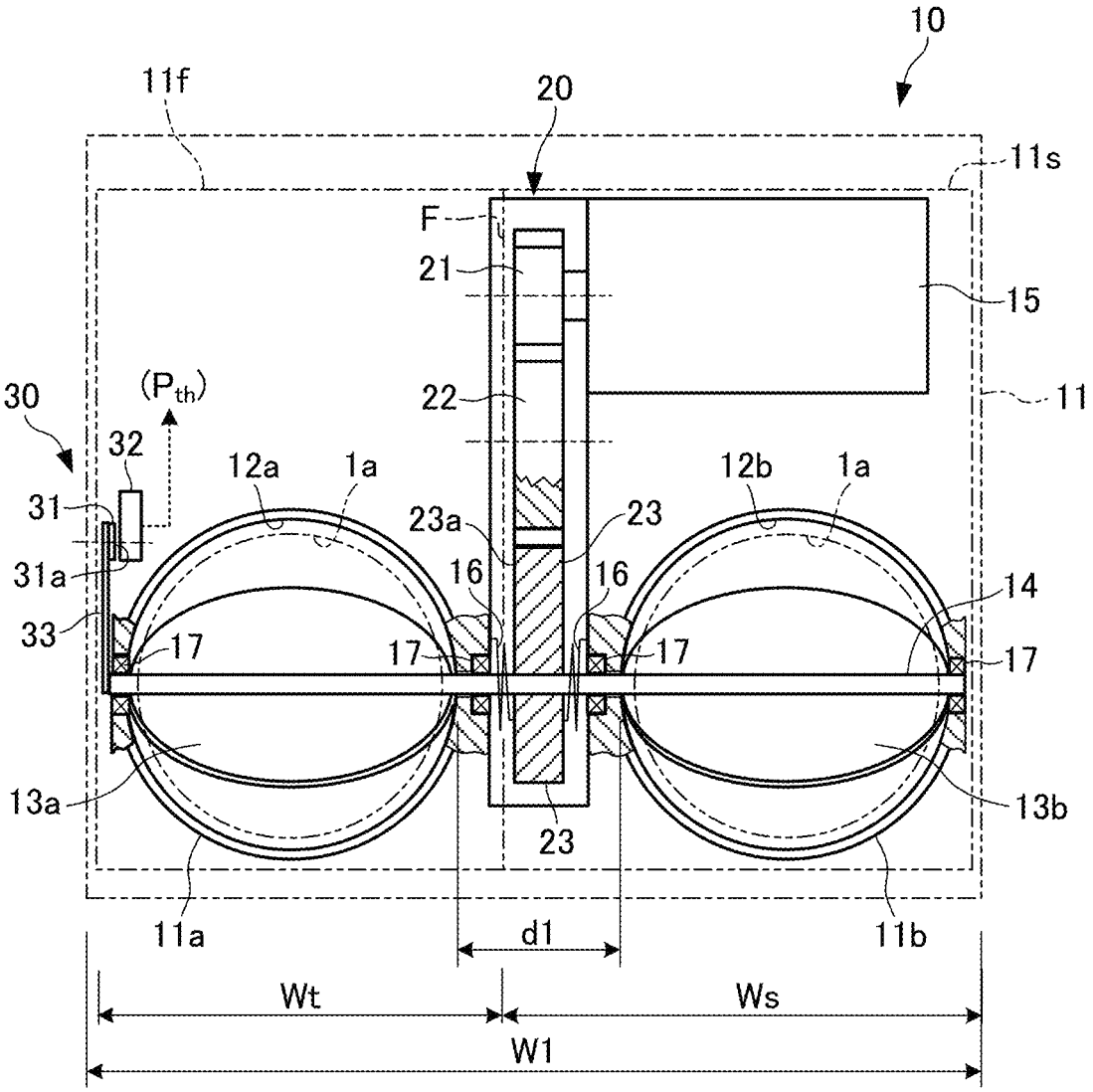
FIG. 1 is a schematic configuration diagram of a main part of a throttle device according to the first embodiment of the present invention.
Figure 2:
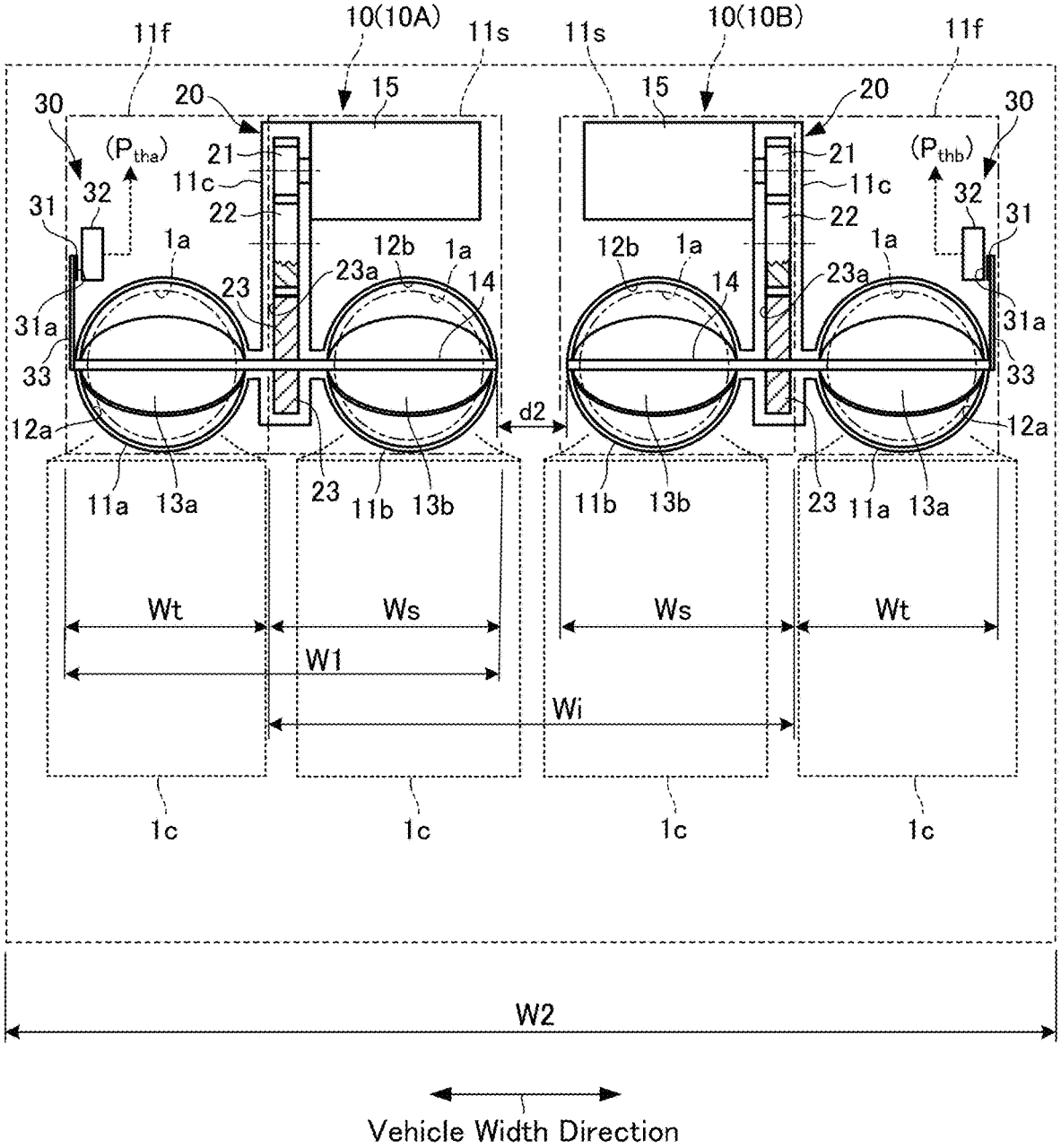
FIG. 2 is a schematic configuration diagram of a throttle device in its entirety in the case that the throttle device according to the first embodiment of the present invention is mounted on a four-cylinder engine.
Figure 3:
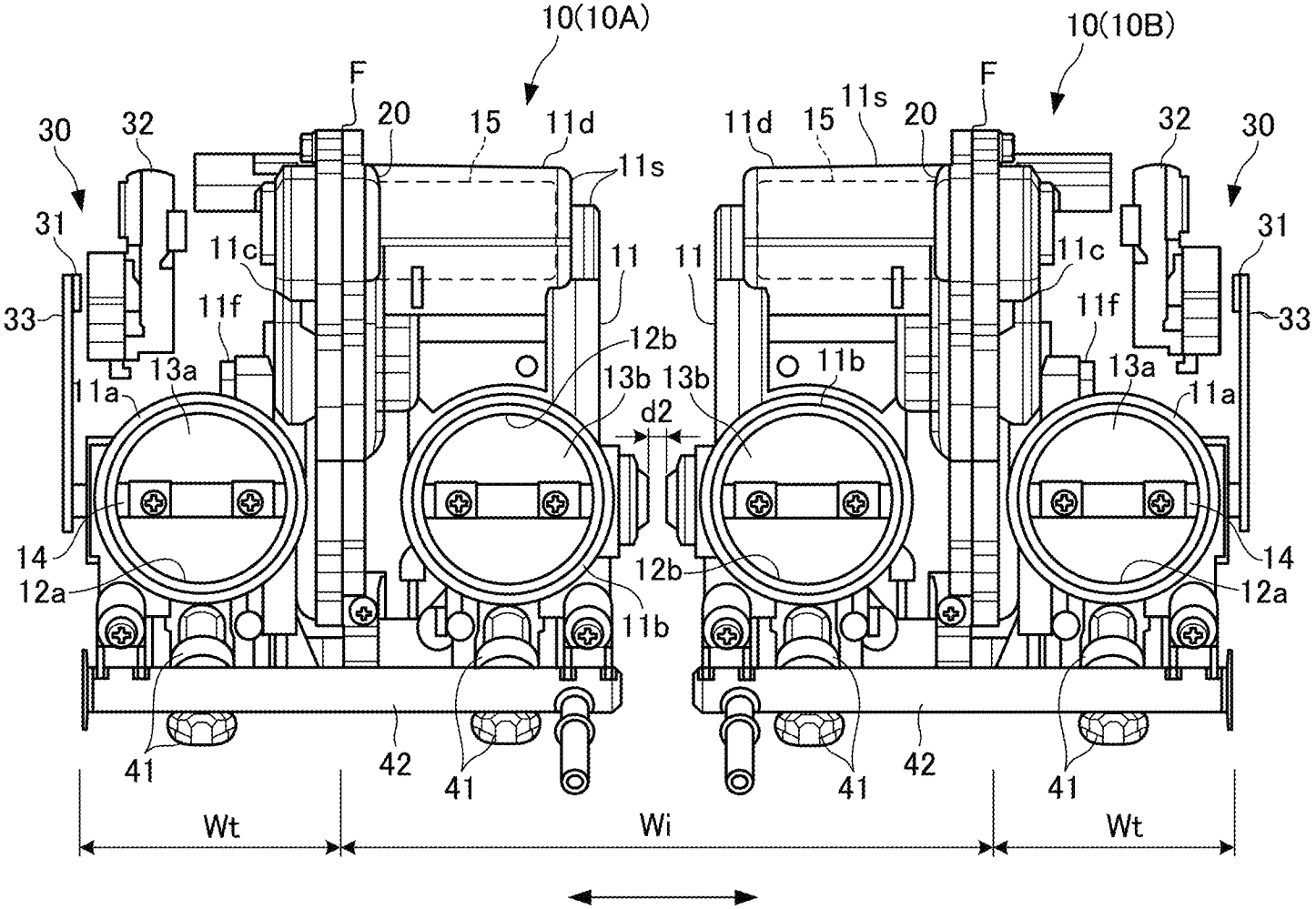
FIG. 3 is a front view of a throttle device in the case that the throttle device according to the first embodiment of the present invention is mounted on a four-cylinder engine.

FIGS. 1-3 show a configuration of a throttle device according to the first embodiment of the present invention.

First, the configuration will be described.

As shown in FIG. 1 and FIG. 2, the throttle device 10 of the present embodiment is a multiple type throttle device mounted to a multi-cylinder internal combustion engine, for example, a four-cylinder engine 1 for a two-wheeled vehicle. Although not described in detail here about the engine 1, a plurality of cylinders 1*c* are mounted in a horizontally placed state to be adjacent to each other in the left-right direction (vehicle width direction) with respect to the body frame extending in the front-rear direction of the two-wheeled vehicle (the direction perpendicular to the paper surface of FIG. 2). As shown in FIG. 3, a pair of throttle devices 10 (10A, 10B in FIG. 3) are arranged in parallel to the engine 1 so as to be adjacent to each other on the left and right sides.

As shown in FIG. 1, the throttle device 10 includes a throttle body portion 11*a* (a first throttle body) having an intake passage 12*a* (a first intake passage), a throttle body portion 11*b* (a second throttle body) having an intake passage 12*b* (a second intake passage), a common (same) throttle shaft 14 rotatably supported with respect to the throttle body portions 11*a* and 11*b*, a motor 15 capable of opening and closing the plurality of the throttle bulbs 13*a* and 13*b* through the throttle shaft 14 and a rotation transmission mechanism 20. Further, the rotation transmission mechanism 20 is disposed between the throttle body portions 11*a* and 11*b*, so as to be connected to the throttle shaft 14 in the vicinity of a width direction position F corresponding to a body joining position between the adjacent throttle valves 13*a* and 13*b*, so that the rotation transmission mechanism 20, disposed between the throttle body portions 11*a* and 11*b*, can transmit power to the substantially central position of the throttle shaft 14.

In FIG. 2, the throttle devices 10 are exemplified by a layout adapted to the four-cylinder engine 1. In FIG. 2, two throttle devices 10, aligned in a line in the cylinder arrangement direction of the engine 1, each covering a plurality of intake ports 1*a*, each for two cylinders, each having a full width W1, respectively have a unit body 11 including throttle body portions 11*a* and 11*b* integrated therein. The throttle body portions 11*a*, 11*b* respectively have an inner circumferential wall surface of a circular cross section and are arranged to be parallel to each other, and form a plurality of intake passages 12*a*, 12*b* (a plurality of branch passages in the case of a manifold) communicating with the plurality of intake ports 1*a*. Further, a plurality of throttle valves 13*a*, 13*b* are provided in the respective intake passages 12*a*, 12*b*, so that the opening degree of throttle valves 13*a*, 13*b* can be controlled. In FIG. 1, the shape of the body portion (unit body 11 to be described later) except for the plurality of throttle body portions 11*a* and 11*b* and a periphery of a rotational transmission path between the throttle body portions 11*a* and 11*b* are schematically shown with a quadrangle. In addition, the plurality of throttle valves 13*a* and 13*b* are respectively of a type in which they are rotated in the valve opening and closing directions, for example a butterfly type, but may be of other types.

FIG. 3 shows one embodiment of a case that the throttle device 10 is applied to a four-cylinder engine 1 for a two-wheel vehicle. As shown in FIG. 3, a unit body 11 has a first segment body (first throttle body) 11*f* and a second segment body (second throttle body) 11*s* integrally connected in a direction (left-right direction in FIG. 3) that the throttle body portions 11*a*, 11*b* are adjacent to each other. The first segment body 11*f* has a gear cover portion 11*c* covering and accommodating the rotation transmission mechanism 20 from one side and one of the throttle body portions 11*a*, 11*b* integrally connected. The second segment body 11*s* has a motor cover 11*d*(accommodation portion) accommodating a motor 15 and the other one of the throttle bodies 11*b*, 11*a* integrally connected. And a plurality of fuel injection valves 41 capable of injecting fuel are disposed in the plurality of the intake passages 12*a*, 12*b*, with respect to each of the first segment body 11*f* and the second segment body 11*s*, while a fuel pipe 42 that distributes and supplies fuel to the plurality of the fuel injection valves 41 is disposed so as to connect the first segment body 11*f* and the second segment body 11*s*.

Returning to FIGS. 1-2, the throttle shaft 14 functions as a rotation center axis for rotatably supporting the plurality of throttle valves 13 in a fixed length region on both end sides thereof, and rotates in accordance with the rotational (angular variation) operation amount from the motor 15 through the rotation transmission mechanism 20 at its center portion in a shaft direction of the throttle shaft 14, thereby making it possible to control an opening degree of the throttle valves 13.

The motor 15 is an actuator, which is for example a pulse motor such as a step motor or the like, and is adapted to control the rotational angle position of the throttle shaft 14 corresponding to the opening position (throttle position) required for the throttle valves 13, according to the acceleration request input based on the accelerator operation of the two-wheeled vehicle.

The rotation transmission mechanism 20 includes a pinion 21 integrally mounted on the rotation output shaft of the motor 15, an idler gear 22 supported on the throttle body 11 so as to be rotatable around the axis while being engaged with the pinion 21, and a control gear 23 integrally connected to the throttle shaft 14 while being engaged with the idler gear 22.

This means that the rotation transmission mechanism 20 is provided, between a pair of intake passages 12 adjacent to each other in the left-right direction of the vehicle, with a pinion 21, which is a gear serving as a first transmission member driven by the motor 15, and a control gear 23 which is a gear interlocked with the pinion gear 21 and serving as a second transmission member integrally connected to the throttle shaft 14 in the rotation direction, and is further provided with an idler gear 22 interposed between the both gears.

In the rotation transmission mechanism 20, the pitch circle radius increases in the order of the pinion 21, the idler gear 22, and the control gear 23, which are interposed between the motor 15 and the throttle shaft 14, thereby making it possible to fulfill the deceleration function and the high precision positioning function.

The throttle device 10 further includes a movable side detection element 31 integrally (integrally in rotation direction) supported by one end of the throttle shaft 14 and a fixed side detection element 32 supported by the throttle body 11, and the movable side detection element 31 and the fixed side detection element 32 collectively constitute a position sensor 30 (throttle opening degree sensor) adapted to detect the angular displacement of the throttle shaft 14 and the control gear 23, which is the displacement of the specific portion in the rotation transmission mechanism 20 corresponding to the opening degree of the throttle valves 13*a*, 13*b*, and to output a position signal Pth. The position signal Pth mentioned here represents a signal to control the opening degree of the throttle valves 13*a*, 13*b* by the motor 15 through the rotation transmission mechanism 20 according to the acceleration request based on the throttle operation of the two-wheel vehicle.

The movable side detection element 31 of the position sensor 30 is integrally supported by the control gear 23 through a plate-shaped lever member 33 integrally connected to one end portion of the throttle shaft 14, and a rotation radius of the movable side detection element 31 around the axis line of the throttle shaft 14 is set, for example, about a pitch circle radius of the control gear 23.

In addition, the movable side detection element 31 is disposed in an inner side, of the both sides of the plate-shaped lever member 33, opposing the side surface 23*a* on one end side in a teeth width (tooth trace) direction of the control gear 23 and constituted by a magnet (can be a magnetic pattern in which magnetic poles of N/S are alternately inverted) or a brush. On the other hand, the fixed side detection element 32 of the position sensor 30 is constituted by a Hall element or a resistance coating film.

The lever member 33 is connected to the throttle shaft 14, to serve as a displacement transmission mechanism to transmit a rotational displacement of the throttle shaft 14 to a predetermined detection radial position by the position sensor 30. As long as integrally rotatable with the throttle shaft 14, the lever member 33 may be, for example, a rod-shaped or plate-shaped member that supports a brush serving as the movable side detection element 31, or a fan-shaped member or a plurality of radially arranged plate-shaped members that supports an arc-shaped magnetic pattern or the like.

Thus, the throttle device 10 according to the present embodiment is so configured that the throttle valves 13 in a plurality of intake passages 12 are rotatable supported through the throttle shaft 14 and opened and closed by the motor 15, and the rotation transmission mechanism 20 interposed between the motor 15 and the throttle shaft 14 has the control gear 23 serving as a transmission member integrally connected with the throttle shaft 14 in the rotational direction between the plurality of the intake passages 12.

Further, the position sensor 30 that detects the rotational displacement of the throttle valves 13 and the throttle shaft 14 is constituted by the movable side detection element 31 integrally supported by the one end portion of the throttle shaft 14 in a rotational direction, and the fixed side detection element 32 disposed in a central side in the axial direction of the throttle shaft 14 with respect to the movable side detection element 31.

By the way, in the present embodiment, the rotational transmission mechanism 20 is provided with its rotational transmission portion (gear meshing portion) at a position where the first segment body 11 *f* and the second segment body 11*s* are adjacent to each other, and the motor 15 constituting an actuator is disposed within the installation width Ws of the second segment body 11*s* having its accommodation portion integrated with the throttle body portion 11*b* (which may be the throttle body portion 11*a*). Further, the second segment body 11*s* is integrally connected with a gear cover portion 11*c* covering the rotation transmission mechanism 20 from one surface side.

On the other hand, the position sensor 30 that outputs the position signal Pth for controlling the motor 15 is disposed within the installation width Wt of the first segment body 11*f*.

Further, the lever member 33 serving as a displacement transmission mechanism is connected to the throttle shaft 14 in an end portion side where the first segment body 11*f* (the other one of the first and the second throttle bodies) is not adjacent to the second segment body 11*s* (either one), and under this state, the fixed side detection element 32 of the position sensor 30 is disposed, with respect to the lever member 33, in the side of a width region (intake passage forming width) in which the intake passage 12*a* (first intake passage) is formed in the first segment body 11*f*.

Further, the throttle valves 13*a*, 13*b* includes a first throttle valve 13*a* provided in the first intake passage 12*a* and a second throttle valve 13*b* provided in the second intake passage 13*b*, and both throttle valves 13*a*, 13*b* are fixed to the identical throttle shaft 14, so that they are synchronously driven by the motor 15 via the rotation transmission mechanism 20.

Next, the operation will be described.

In the throttle device 10 of the present embodiment, when the pinion 21 is driven by the motor 15 in response to the acceleration request input according to the accelerator operation of the two-wheeled vehicle, the throttle shaft 14 rotates integrally with the control gear 23 that is engaged therewith, so that the degree of opening of the throttle valves changes. This means that the control of the rotational angle position of the throttle shaft 14 corresponding to the opening degree position required for the throttle valves 13 is executed.

During the control of the rotational angular position, the rotational angular position of the movable side detection element 31 integrally supported by the throttle shaft 14 in the rotation direction is detected by the fixed side detection element 32 on the side of the throttle body 11, as the rotational angular position of the throttle valves 13 and the throttle shaft 14, so that the opening degree of the throttle valves 13 is detected, In the present embodiment, it is not necessary to provide a dedicated separate rotation transmission element (a functional portion around the intake passage) in the vicinity of the throttle shaft 14 in order to transmit the angular displacement of the throttle shaft 14 to the position sensor 30. Accordingly, an interval d1 (See FIG. 1) between the two intake passages 12*a*, 12*b* which are disposed adjacent to each other in a cylinder arrangement direction of the engine 1 sandwiching the rotation transmission mechanism 20 and a width dimension of a thick portion (a portion surrounding the rotation transmission mechanism 20) of the unit body 11 corresponding to the d1 can be reduced.

Further, in the present embodiment, two unit bodies 11 are combined to be adapted to the four-cylinder engine 1, so that an interval d2 (Refer to FIG. 2 and FIG. 3) between the two central throttle valve portions 11*b* can be narrowed. Furthermore, by combining the two unit bodies 11 to the four-cylinder engine 1, the degree of freedom of mounting also increases.

Furthermore, in the present embodiment, the rotation transmission mechanism 20 is disposed in the vicinity of the position where the first and the second segment bodies 11*f*, 11*s* are adjacent to each other, and the motor 15 is disposed within an installation width Ws of either one of the first and the second segment bodies 11*f*, 11*s*, and the throttle opening degree sensor 30 is disposed within an installation width Wt in the vehicle width direction of the other one of the first and the second segment bodies 11*f*, 11*s*, respectively. Therefore, while the motor 15 is accommodated in one segment body 11*s*, which is one of the first and the second segment bodies 11*f*, 11*s*, the position sensor 30 detecting the rotational displacement of the throttle shaft 14 is disposed within the installation width Wt of the other segment body 11*f*, so that the position sensor 30 does not protrude from the end portion of the throttle body, thereby making it possible to reduce the width of the full width W1 of the throttle device. However, the two motors 15 of both the rotation transmission mechanisms 20 of the left and right throttle devices 10A, 10B may be arranged in the installation width region Wi (Refer to FIG. 2) in the central side of the vehicle width direction, inclusive of the installation width Ws in the vehicle width direction of the left and right two segment bodies 11*s*.

And in addition, in the present embodiment, by appropriately setting a length of the lever member 33, a disposing position, particularly a rotation radius, of a movable side detection element 31 which displacement is detected by the position sensor 30 can be appropriately set, so that it becomes possible to secure the required throttle opening degree detection accuracy through extending the detection width of the rotational displacement of the movable side detection element 31, thereby to increase the degree of freedom of the disposition and the size of the fixed side detection element 32. Further, in the present embodiment, the lever member 33 of the position sensor 30 is connected to the throttle shaft 14 at an end portion side of the first segment body 11*f*, and the fixed side detection element 32 of the position sensor 30 is disposed in a side forming the intake passage 12*a* in the first segment body 11*f*. Therefore, while realizing an easy-to-handle disposition where the throttle opening degree sensor 30 and the rotation transmission mechanism 20 are disposed to be spaced part from each other in the axis direction of the throttle shaft 14, the position sensor 30 avoids from protruding in a width direction from the end portion of the throttle body 11, so that the full width W1 of the throttle device can be reduced.

Further, in the present embodiment, since the throttle valves 13*a*, 13*b* are fixed to the identical throttle shaft 14, a plurality of the throttle valves 13*a*, 13*b* disposed in the plurality of intake passages 12*a*, 12*b* in the vicinity of the intake ports 1*a* of the engine 1 can be driven by the identical motor 15 in response to the throttle operation in a high response and accurate manner.

Thus, according to the throttle device 10 of the present embodiment, the position sensor 30 does not need to protrude out of the range of the full width W1 of the throttle body 11, so that the throttle device 10 can be made compact and the degree of freedom of arrangement can be increased.

Comparison Example

Figure 4A:
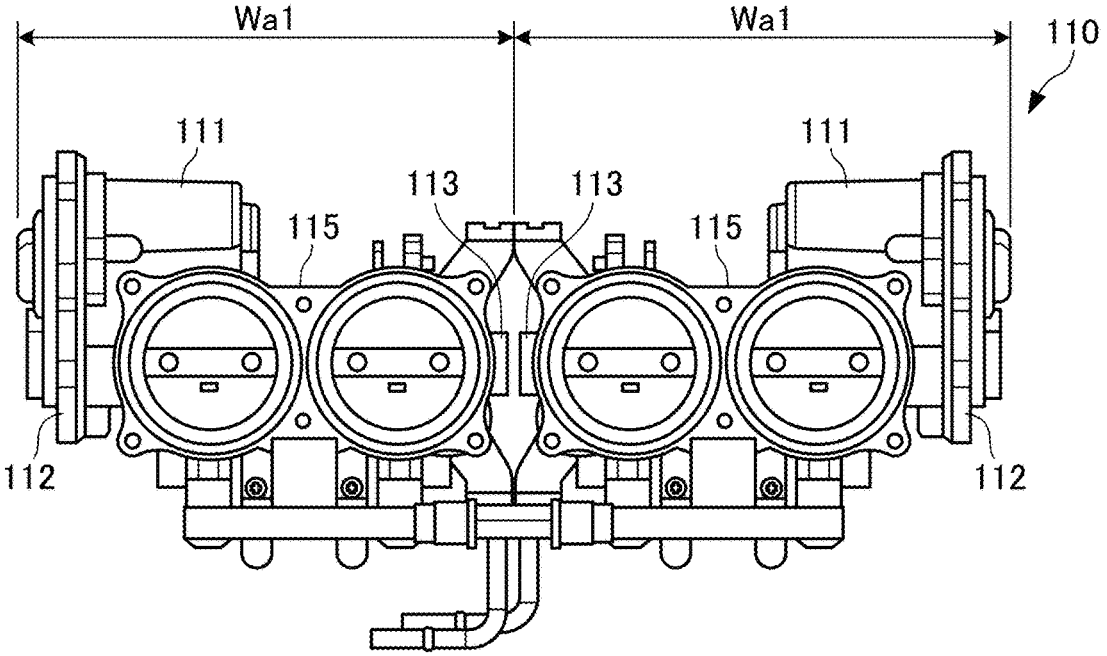
FIGS. 4A and 4B are front views of an exemplary comparison of two throttle devices mounted on the four-cylinder engine.
Figure 4B:
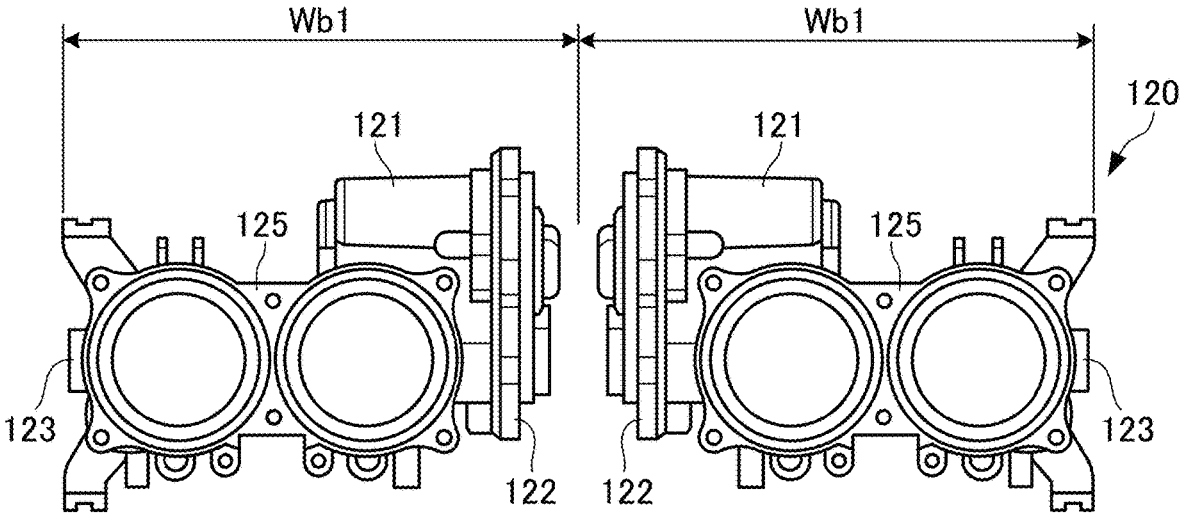

FIGS. 4A and 4B show conventional throttle devices 110, 120 applied to the four cylinders of the engine. In the figure, the gear transmission mechanisms 112, 122 and the position sensors 113, 123, which perform rotational transmissions from the motors 111, 121 to the throttle shaft (without a reference numeral), are disposed at both ends of the respective throttle shafts. In this case, the angular displacement of the throttle shaft can be directly detected by the position sensors 113, 123, and it is possible to exclude errors due to backlashes in a transmission path as in the case of providing a sensor on the side of the motors 111, 121. However, in this case, due to the existence of both throttle position sensors 113, 123 and the gear transmission mechanism 112, 122, the full widths Wa1, Wb2 of the throttle devices 110, 120 become larger with respect to the full width of the throttle body 115, 125, respectively by the widths of the gear transmission mechanism 112, 122 or the throttle position sensors 113, 123.

Therefore, it can be concluded that the throttle device according to the present invention can contribute sufficiently to the miniaturization of the throttle device and the improvement of the mountability to the engine, while ensuring favorable detection accuracy, as compared with the comparison example of the conventional configuration.

Second Embodiment

Figure 5:
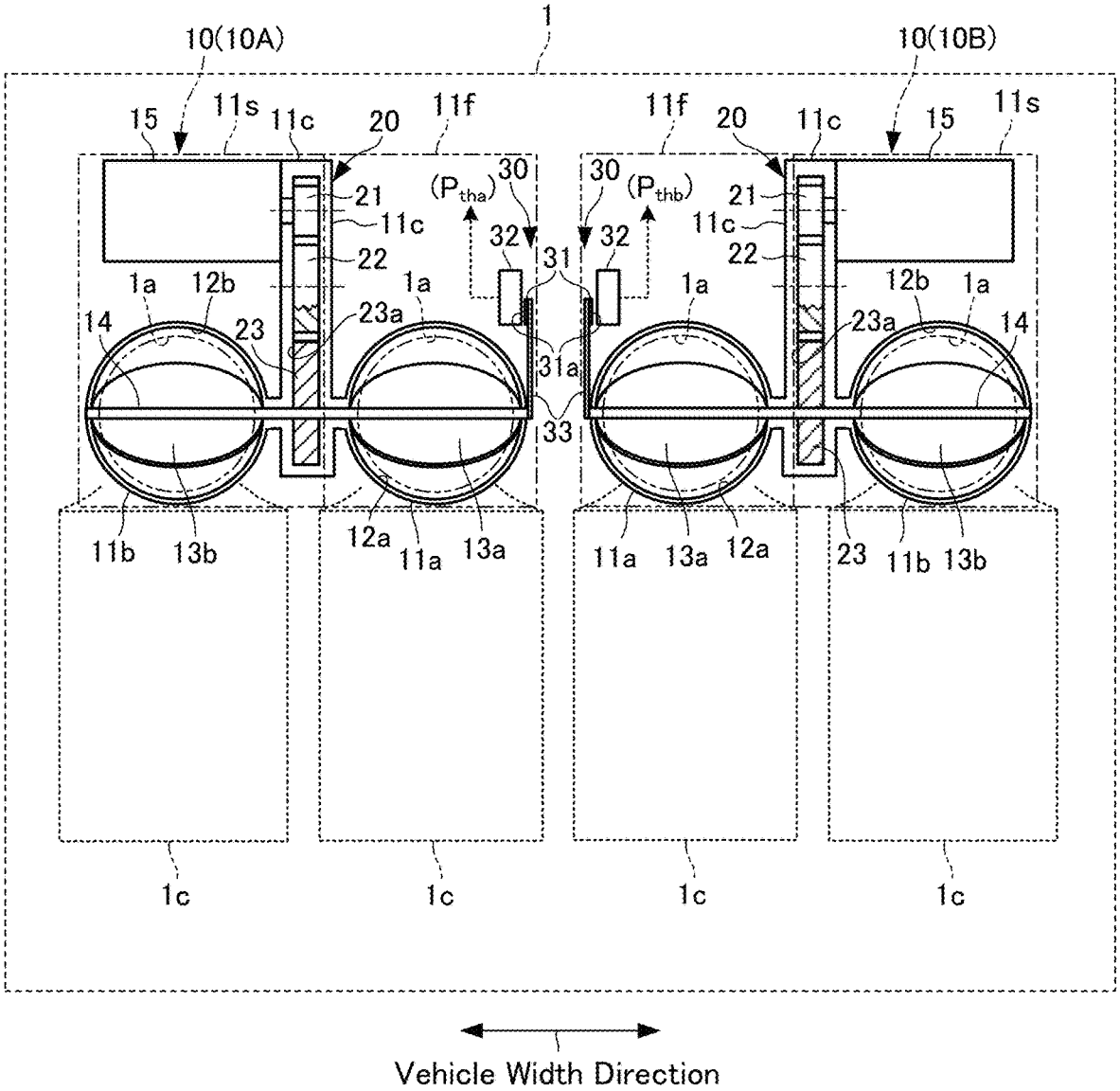
FIG. 5 is a schematic configuration diagram of a throttle device in its entirety in the case that the throttle device according to the second embodiment of the present invention is mounted on a four-cylinder engine.

FIG. 5 shows a configuration of the throttle device according to the second embodiment of the present invention.

In the throttle device 10 of the present embodiment, the left and the right throttle devices 10A, 10B corresponding to the left and the right two cylinders of the engine 1 are reversed from the first embodiment shown in FIG. 2, so that the motor 15 and the position sensor 30 of each of the throttle devices 10A, 10B are arranged in reverse.

Other configurations are the same as those of the first embodiment described above, and in this embodiment, the same effect as that of the above-described first embodiment can be obtained.

Also in the present embodiment, as in the first embodiment, it is possible to provide a high mountability throttle device which suppresses the full width W2 of the engine 1 and is easy to be disposed in a body frame of a two-wheel vehicle.

Third Embodiment

Figure 6:
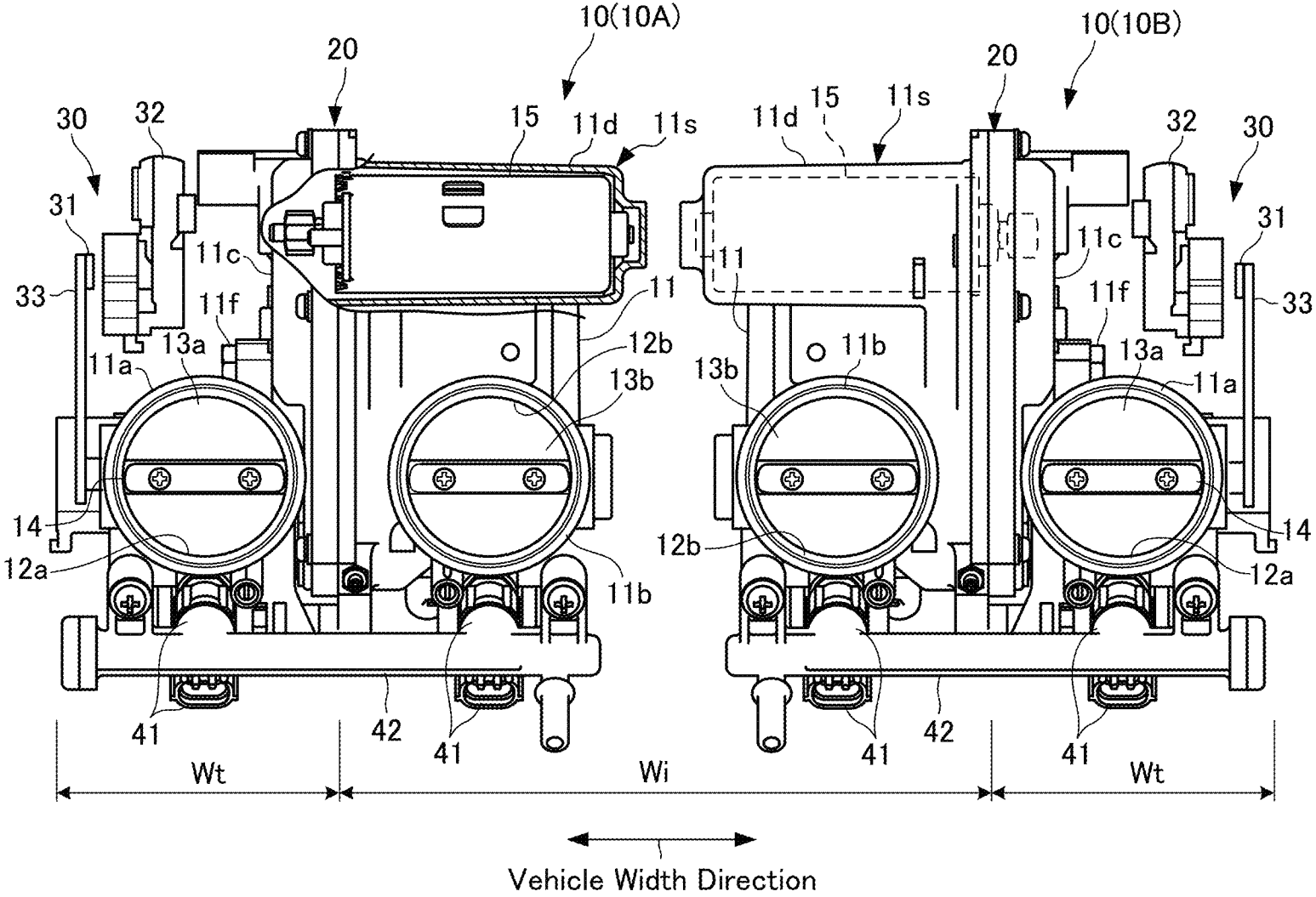
FIG. 6 is a front view of a throttle device in the case that the throttle device according to the third embodiment of the present invention is mounted on a four-cylinder engine

FIG. 6 shows a configuration of a throttle device according to a third embodiment of the present invention.

In the throttle device 10 of the present embodiment, similarly to the first embodiment shown in FIG. 2, the rotation transmission portion (gear meshing portion) of the rotation transmission mechanism 20 is disposed at the position where the first segment body 11*f* and the second segment body 11*s* are adjacent to each other, and left and right throttle devices 10A, 10B corresponding to left and right two cylinders of the engine 1 are linearly arranged. Further, the motor 15, constituting an actuator, is disposed on the inner side in the vehicle width direction with respect to each of the rotation transmission mechanisms 20, and the respective position sensors 30 are arranged on the outer side in the vehicle width direction.

However, In the present embodiment, the motor cover portion 11*d* projects inward in the vehicle width direction from the width of the throttle body portion 11*b*, while in the first embodiment, the motor cover portion 11*d* accommodating the motor 15 is disposed within the width of the throttle body portion 11*b* which is the main portion of the second segment body 11*s* in the vehicle width direction.

However, both the motor cover portions 11*d* of the left and right throttle devices 10A, 10B are disposed within the installation width region Wi (refer to FIG. 6) in the center side in the vehicle width direction inclusive of the installation width Ws (refer to FIG. 2) of the second segment body 11*s* of the left and right throttle devices 10A, 10B, and does not protrude outward in the vehicle width direction.

In FIG. 6, the respective motors 15 of the left and right throttle devices 10A and 10B are shown on the same straight line, but they may be arranged on different parallel axes.

Other configurations are the same as those of the first embodiment described above. In the present embodiment, as well as in the first embodiment, it is possible to suppress the entire width W2 (refer to FIG. 2) of the engine 1 and to provide a highly mountable throttle device which is easy to mount on the frame of a two-wheel vehicle.

In each of the above-described embodiments, the throttle device is mounted on a four-cylinder engine or a three-cylinder engine, but the present invention is also applicable to a throttle device mounted on an engine of two or more cylinders. In addition, the motor may be any electric actuator that can generate rotation. Further, although the rotation transmission mechanism 20 is exemplified by employing three gears, the number of gears may be arbitrary, and the rotation transmission elements may be other than gears. When a plurality of throttle devices 10 respectively for two cylinders are arranged in the cylinder arrangement direction, instead of disposing the motor 15 on one side in the left-right direction of the vehicle with respect to the rotation transmission mechanism 20 as shown in FIG. 2, the motor 15 may be arranged to be inverted on both sides in the left-right direction of the vehicle body, considering the center of gravity in relationship with other equipment.

Further, it is needless to say that each of the first and the second segment bodies 11*f*, 11*s* may have a plurality of intake passages formed therein, and three or more throttle valves may be rotated by the same motor 15.

As described above, according to the present invention, it is not necessary to dispose the throttle position sensor so as to protrude outside the full width range of the throttle body, so that it is possible to achieve the effect that the throttle device can be miniaturized and the degree of freedom of arrangement of the throttle device can be increased, and thus the present invention is useful for a multilateral throttle device in general suitable for a throttle device in which a plurality of throttle valves on the intake passage of an engine are controlled by an actuator in common.

EXPLANATION OF REFERENCE NUMERALS

1 engine
1*a* intake port
10, 10A, 10B throttle device
11 throttle body
11*a* throttle body portion (first throttle body)
11*b* throttle body portion (second throttle body)
11*f* first segment body (first throttle body)
11*s* second segment body (second throttle body)
12*a* intake passage (first intake passage)
12*b* intake passage (second intake passage)

13*a*, 13*b* throttle valve
14 throttle shaft
15 motor (actuator)
20 rotation transmission mechanism
21 pinion (first transmission member, gear)
22 idler gear (gear)
23 control gear (second transmission member, gear, displacement transmission mechanism)
23*a* opposing surface
30 throttle position sensor (throttle opening degree sensor)
31 movable side detection element (magnet or brush)
32 fixed side detection element (Hall element or resistance coating film)
33 lever member (displacement transmission mechanism)
41 fuel injection valve
42 fuel pipe
d1 first inter passage region
d2 second inter passage region
F width direction position (width direction position between adjacent throttle valves)
W1 full width
Ws installation width (one installation width)
Wt installation width (the other installation width)
Wi installation width region in the center side in the vehicle width direction

The invention claimed is:

1. A throttle device mountable on a multiple cylinder engine having an intake port, the throttle device comprising:

a first throttle body having a first intake passage formed therein;

a second throttle body having a second intake passage adjacent to the first intake passage formed therein;

a first throttle valve rotatably provided in the first intake passage;

a second throttle valve rotatably provided in the second intake passage;

a throttle shaft supporting the first throttle valve and the second throttle valve;

an actuator that drives the throttle valve to open and close through the throttle shaft;

a rotation transmission mechanism interposed between the actuator and the throttle shaft;

a displacement transmission mechanism connected to the throttle shaft and transmits a rotational displacement of the throttle shaft to a predetermined detection position; and a throttle opening degree sensor to detect the opening degree of the throttle valve the displacement transmission mechanism, wherein the rotation transmission mechanism is disposed at a position where the first throttle body and the second throttle body are adjacent, the actuator is disposed within an installation width of either one of the first and the second throttle bodies, the throttle opening degree sensor includes a movable side detection element and a fixed side detection element, the movable side detection element being integrally supported by one end of the throttle shaft through the displacement transmission mechanism, the throttle opening degree sensor disposed within an installation width of other one of the first and the second throttle bodies and the displacement transmission mechanism is connected to the throttle shaft at an end portion side where the other one of the first and the second throttle bodies is not adjacent to the either one of the first and the second throttle bodies and the displacement transmission mechanism transmits a rotational displacement of the throttle shaft to the throttle opening degree sensor.

2. The throttle device according to claim 1, wherein the throttle opening degree sensor is disposed in an intake passage side in the other one of the first and the second throttle bodies, with respect to the displacement transmission mechanism.

3. The throttle device according to claim 1, wherein the fixed side detection element is disposed in a central side in the axial direction of the throttle shaft with respect to the movable side detection element.

4. The throttle device according to claim 1, wherein the displacement transmission mechanism is a lever member.

5. An engine, comprising a plurality of the throttle devices according to claim 1, wherein the throttle devices are linearly arranged in a vehicle width direction.

6. An engine, comprising a plurality of the throttle devices according to claiml, wherein motor axes of the throttle devices are arranged in parallel with respect to a vehicle width direction.

* * * * *